US008992242B2

(12) United States Patent
Casses et al.

(10) Patent No.: US 8,992,242 B2
(45) Date of Patent: Mar. 31, 2015

(54) ELECTRICAL CONNECTOR ASSEMBLY

(75) Inventors: Claude Casses, Clevilliers (FR); Frederic Menez, Hermeray (FR); Stephane Trancart, Faverolles (FR)

(73) Assignee: Delphi Intellectual Operations Luxembourg S.A.R.L., Luxembourg (LU)

( * ) Notice: Subject to any disclaimer, the term of this patent is extended or adjusted under 35 U.S.C. 154(b) by 220 days.

(21) Appl. No.: 13/518,554

(22) PCT Filed: Dec. 24, 2009

(86) PCT No.: PCT/IB2009/056057

§ 371 (c)(1),
(2), (4) Date: Jan. 9, 2013

(87) PCT Pub. No.: WO2011/077194

PCT Pub. Date: Jun. 30, 2011

(65) Prior Publication Data

US 2013/0130530 A1 May 23, 2013

(51) Int. Cl.
*H01R 13/52* (2006.01)

(52) U.S. Cl.
CPC ..... *H01R 13/5205* (2013.01); *H01R 13/5219* (2013.01)
USPC ..... 439/271

(58) Field of Classification Search
CPC ..... H01R 13/5202
USPC ..... 439/271
See application file for complete search history.

(56) References Cited

U.S. PATENT DOCUMENTS

| | | | | |
|---|---|---|---|---|
| 5,484,301 | A | 1/1996 | Koumatsu et al. | |
| 5,595,496 | A * | 1/1997 | Konda et al. | 439/271 |
| 5,637,006 | A * | 6/1997 | Almeras | 439/191 |
| 5,720,629 | A * | 2/1998 | Self et al. | 439/587 |
| 5,730,625 | A * | 3/1998 | Sikora | 439/595 |
| 5,934,938 | A * | 8/1999 | Clark et al. | 439/587 |
| 6,953,357 | B2 * | 10/2005 | Fukushima et al. | 439/271 |
| 7,011,539 | B1 | 3/2006 | Nagy et al. | |
| 8,562,377 | B2 * | 10/2013 | Kawamura | 439/607.44 |
| 8,777,647 | B2 * | 7/2014 | Buehman et al. | 439/271 |
| 2003/0017728 | A1 * | 1/2003 | Ogawa | 439/79 |
| 2007/0184701 | A1 * | 8/2007 | Yagome et al. | 439/271 |
| 2013/0130530 | A1 * | 5/2013 | Casses et al. | 439/271 |

FOREIGN PATENT DOCUMENTS

DE 20 2008 011 017 U1 11/2008

OTHER PUBLICATIONS

English translation of DE 20 2008 011 017 that was a foreign Patent filed on applicant's ids dated Jun. 22, 2012 having a publication date of Nov. 20, 2008.*

* cited by examiner

*Primary Examiner* — James Harvey
(74) *Attorney, Agent, or Firm* — Robert J. Myers

(57) ABSTRACT

An electrical connector assembly including a first connector and a second connector. The first connector includes a socket and the second connector including a sleeve, the socket being adapted to surround the sleeve. A sealing system includes a frontward portion surrounding the sleeve and a rearward portion surrounding a rear housing of the second connector.

9 Claims, 13 Drawing Sheets

FIG. 11
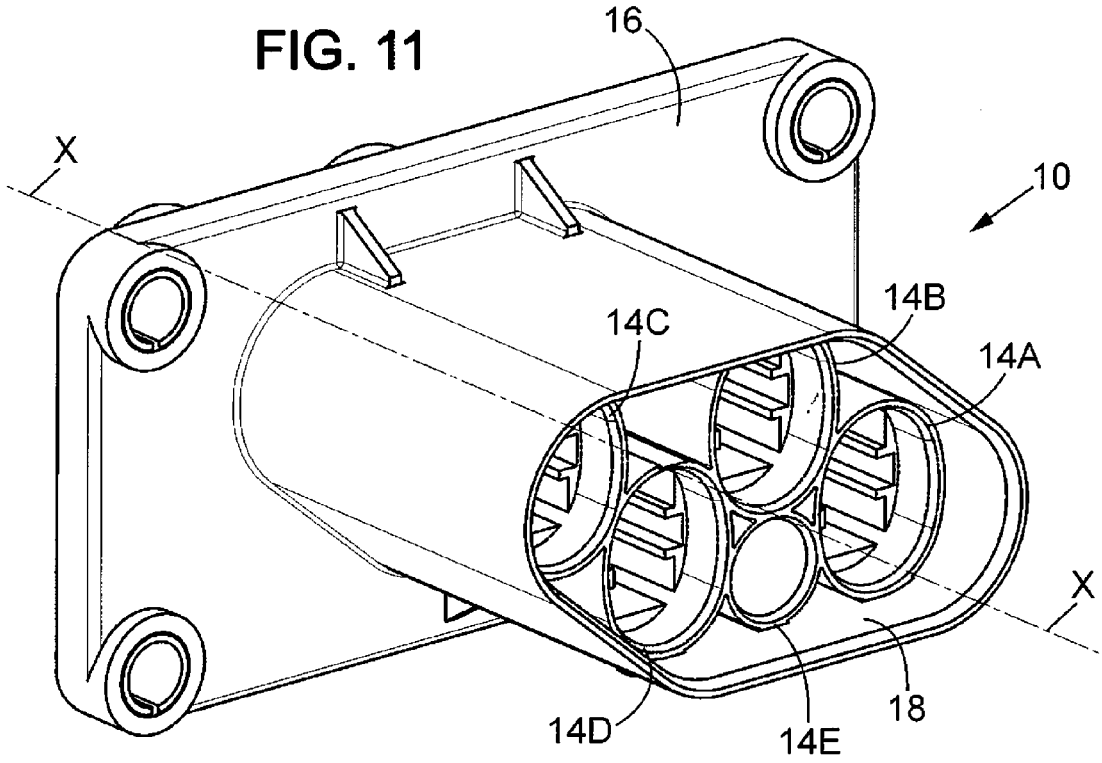
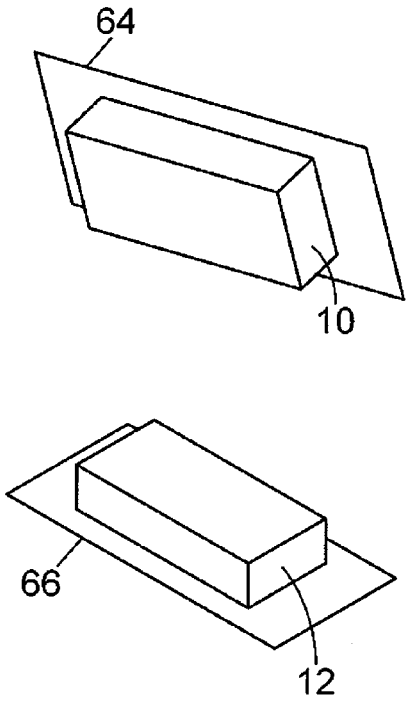
FIG. 14

ELECTRICAL CONNECTOR ASSEMBLY

FIELD OF THE INVENTION

The invention relates to connector assemblies, for instance power connector assemblies for electricity-fuel hybrid vehicles or fully electrically vehicles.

BACKGROUND OF THE INVENTION

Recent trends in the automotive industry concern these electricity-fuel hybrid vehicles or fully electrical vehicles which are powered by batteries through cables with high current and/or voltage.

Electrical connector assemblies are used to electrically connect the battery to electrical engines or other electrical devices. For instance the connector assembly comprises a pair of connectors adapted to be coupled one to another; a first connector is connected to the battery side, and a second complementary connector is connected to an electrical device or engine.

Electrical connectors usually comprise an insulating casing and electrical terminals. The electrical terminals of both connectors are to be put in electrical contact with each other, while the casings are mechanically connected to each other. For automotive applications a stringent requirement has to be met in terms of watertightness performance. Indeed, the connector assemblies are usually installed in the engine compartment and are therefore exposed to harsh environment in particular to water, dust, etc. Leakage within the connector assembly has to be avoided to prevent short-circuit and corrosion of the metallic terminals. To this end it is known in the prior art to implement water sealing means in the connector assembly that acts as barrier against water. In conventional connector assembly, the sealing means comprises an interfacial sealing joint and/or, in the case of a cable connector, cable seals placed around the electrical wire in order to seal the opening of each chamber to prevent entry of water, moisture or dust from the cable entry side.

Furthermore connector assemblies are used to transmit power. Due to the high current and voltage (e.g. 250A, 600V), it is necessary to provide means to prevent any possible physical contact of the user with the power terminal. At this end, it is known to design the connector housing with touchproof means, such as walls to hinder access to the terminals.

It is an object of the present invention to answer the demand for more reliable and safer connector assemblies, i.e. an improved waterproof connector assembly where the terminal are protected by a touchproof means.

SUMMARY OF THE INVENTION

To this aim, it is provided an electrical connector assembly comprising a first connector having a first casing and a first power contact, and a second connector having a second casing and a first power contact. Of course, the electrical connector assembly of the invention may comprise first and second connectors provided with more than one power contact. The first and second connectors selectively mate and unmate along a mating axis to electrically connect the first power contacts together. The first connector comprises a cylindrical socket surrounding the first power contact of the first connector and the second connector comprises a cylindrical sleeve surrounding the first power contact of the second connector. The cylindrical socket is adapted to surround the cylindrical sleeve when the first and second connectors mate.

A sealing system is provided on the second casing and comprises a frontward portion and a rearward portion. The frontward portion surrounds the cylindrical sleeve to seal between the cylindrical socket and the cylindrical sleeve when the first and second connectors mate. The rearward portion surrounds the rear housing of the second casing to seal between the housing of the first casing and the rear housing of the second casing when the first and second connectors mate.

With these features, the electrical connector assemblies of the present invention are watertight. A first sealing barrier is provided between the socket(s) and the casing and a second sealing barrier is provided between the socket(s) and the sleeve(s); the purpose of the second sealing is to provide an additional sealing in case the first sealing fails. Further the sealing system of the present invention is suitable for connectors having sleeve members whose function is to protect the terminal from being touched by the user.

In various embodiments of the invention, one and/or the other of the features defined in the claims may be incorporated.

BRIEF DESCRIPTION OF THE DRAWINGS

Other characteristics and advantages of the invention will readily appear from the following description of some of its embodiments, provided as non-limitative examples, and of the accompanying drawings.

On the drawings:

FIG. 11 is a perspective view of a first connector of a connector assembly according to another embodiment, FIG. 14 is a schematic view of a system before mating.

On the different Figures, the same reference signs designate like or similar elements.

DETAILED DESCRIPTION

Figure 1:
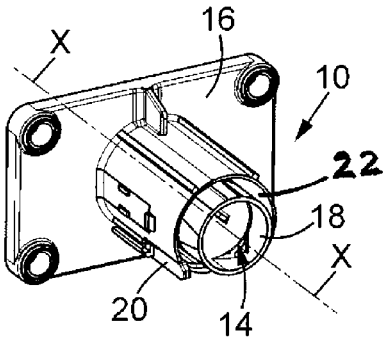
FIG. 1 is a perspective view of a first connector of a connector assembly according to an embodiment.
Figure 2:
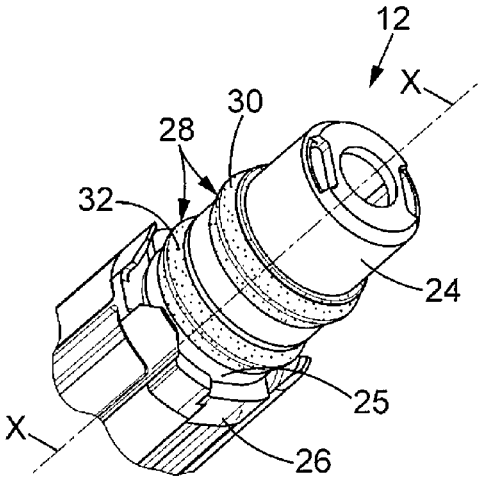
FIG. 2 is a perspective view of a second connector provided with a sealing system and intended to mate with the first connector of FIG. 1.

FIG. 1 shows in details a first connector 10 to mate along a longitudinal mating axis X-X with a second connector 12 illustrated on FIG. 2.

The first connector 10 comprises a cylindrical socket 14 surrounding a first terminal, e.g. a power terminal (not visible on the figures), and extending along the mating axis X-X from a base casing 16. The socket 14 is delimited by a first housing 18 which surrounds the cylindrical socket 14. An outer housing 20 is further provided, surrounding the first housing 18. The inner and outer housings 18 and 20 define an annular space 22.

The second connector of FIG. 2 comprises a cylindrical sleeve 24, surrounding a second terminal (not visible on the figures), and extending along the mating axis X-X from a rear housing 25 provided on a second casing 26. The cylindrical socket 14 is designed to receive this cylindrical sleeve 24 when the first and second connectors mate together along the mating axis X-X.

In order to ensure a sealing between the two connectors 10 and 12, the second casing 26 is provided with a sealing system 28. The sealing system 28 comprises a frontward portion 30 surrounding the cylindrical sleeve 24 to ensure a sealing between the cylindrical socket 14 and the cylindrical sleeve 24 and a rearward portion 32 surrounding the rear housing 25 of the second casing 26 to ensure a sealing between the inner housing 18 of the first casing 16 and the rear housing 25 of the second casing 26 when the first and second connectors 10 and 12 mate.

These frontward 30 and rearward 32 portions can be separate pieces as depicted on FIG. 2 or the sealing system 28 can be of one piece as depicted on FIGS. 6A-C, 10A-C and 14A-C for other embodiments, the frontward portion being integral with the rearward portion.

Figure 3A:
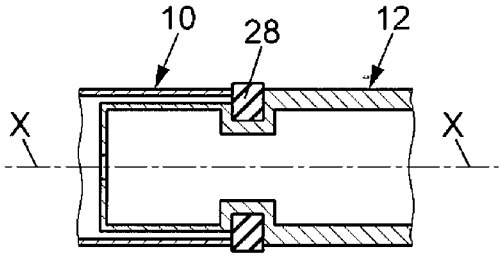
FIG. 3A is schematic section of a sealing system according to an embodiment and provided on a connector assembly.
Figure 3B:
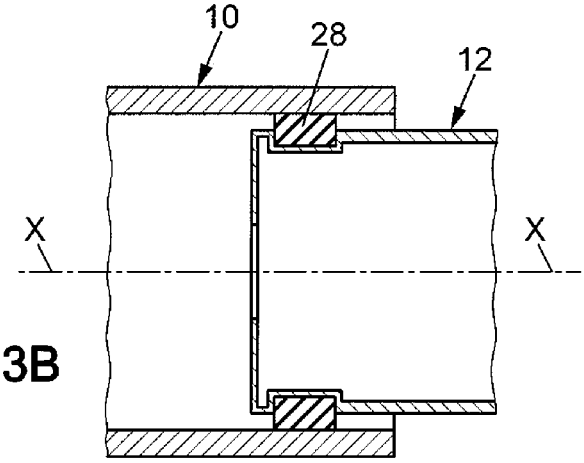
FIG. 3B is schematic view of a sealing system according to another embodiment and provided on a connector assembly.

Each one of the frontward portion and rearward portion of the sealing system 28 achieve either an axial compression sealing with regard to the mating axis X-X (as schematically illustrated on FIG. 3A) or a radial compression sealing with regard to the mating axis X-X as schematically illustrated on FIG. 3B.

In the embodiment illustrated on FIGS. 4, 5A-B, 6A-C, 7 and 8, the connector assembly comprises two pairs of power terminals, one pair on each connector.

Figure 4:
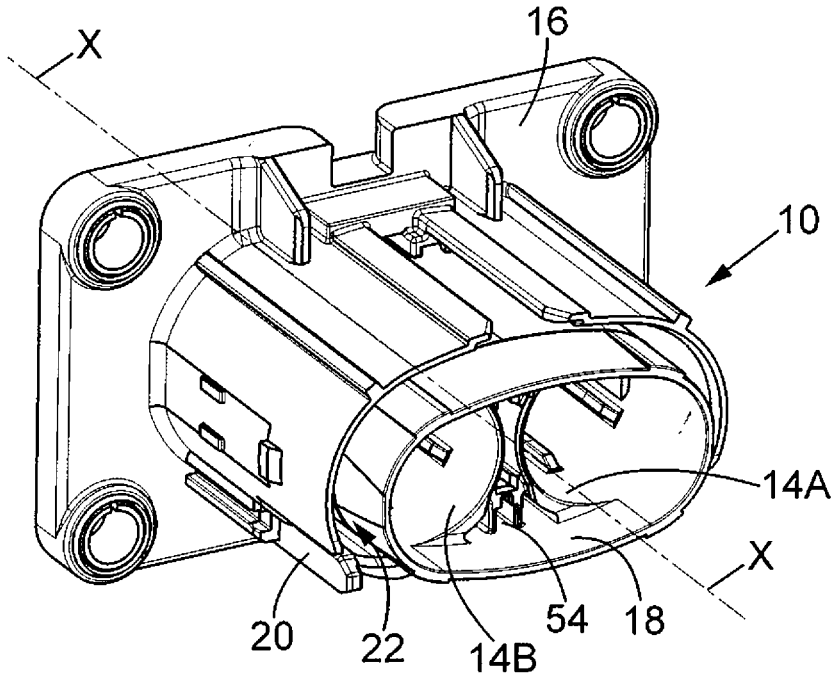
FIG. 4 is a perspective view of a first connector of a connector assembly according to another embodiment.

With reference to FIG. 4, the first connector 10 comprises a first cylindrical socket 14A surrounding a first power terminal and respectively a second cylindrical socket 14B surrounding a second power terminal. Both first 14A and second 14B cylindrical sockets extend along the mating axis X-X from a base casing 16. The base casing 16 is provided with an inner housing 18 surrounding jointly the first 14A and second 14B cylindrical sockets and an outer housing 20 surrounding the inner housing 18. Since the two sockets are provided side by side, the outer contour of the inner housing 18 and of the outer housing 20 may therefore have an oval shape. The inner and outer housings 18 and 20 define an annular space 22.

Figure 5A:
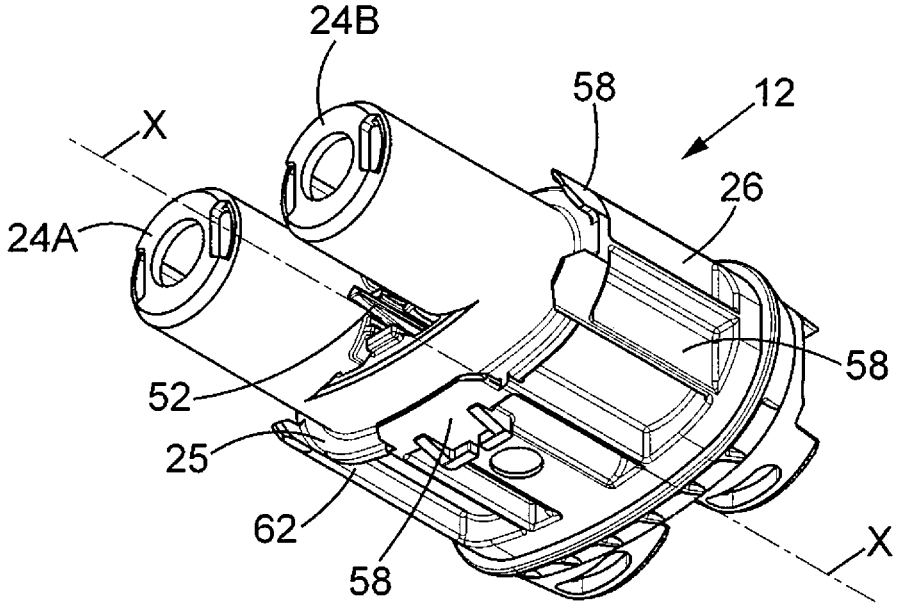
FIG. 5A is a perspective view of a second connector intended to mate with the first connector of FIG. 4.
Figure 5B:
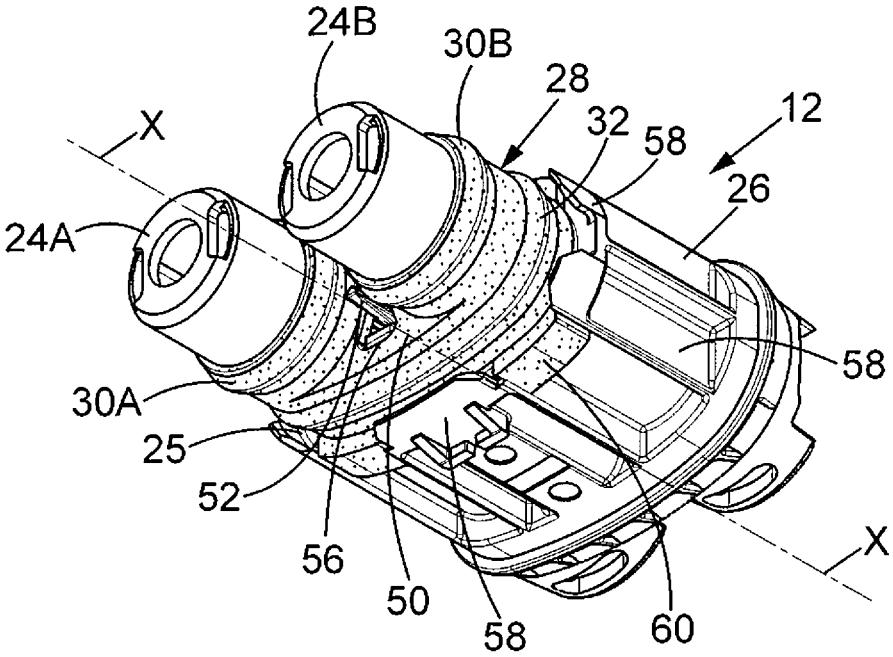
FIG. 5B is a perspective view of the second connector of FIG. 5A provided with a sealing system.

The second connector 12 intended to mate with this first connector 10 of FIG. 4 is illustrated on FIGS. 5A and 5B.

The second connector 12 comprises a two cylindrical sleeve 24A,24B, each of which receiving a complementary power terminal. Both first 24A and second 24B cylindrical sleeves extend along the mating axis X-X from a second casing 26. Each cylindrical socket of the first connector is adapted to receive internally the corresponding cylindrical sleeve of the second connector when the first and second connectors mate together along the mating axis X-X. In order to provide a sealing between the two connectors 10 and 12, the second (plug) connector 12 is provided with a sealing system 28 as illustrated on FIG. 5B.

The sealing system 28 comprises a first frontward portion 30A surrounding the first cylindrical sleeve 24A to ensure a sealing between the first cylindrical socket 14A and the first cylindrical sleeve 24A and a second frontward portion 30B surrounding the second cylindrical sleeve 24B to ensure a sealing between the second cylindrical socket 14B and the second cylindrical sleeve 24B.

The sealing system 28 further comprises a rearward portion 32 surrounding the rear housing 25 of the second casing 26 to ensure a sealing between the inner housing 18 and the rear housing 25 of the second casing 26 when the first and second connectors 10 and 12 mate.

Figure 6A:
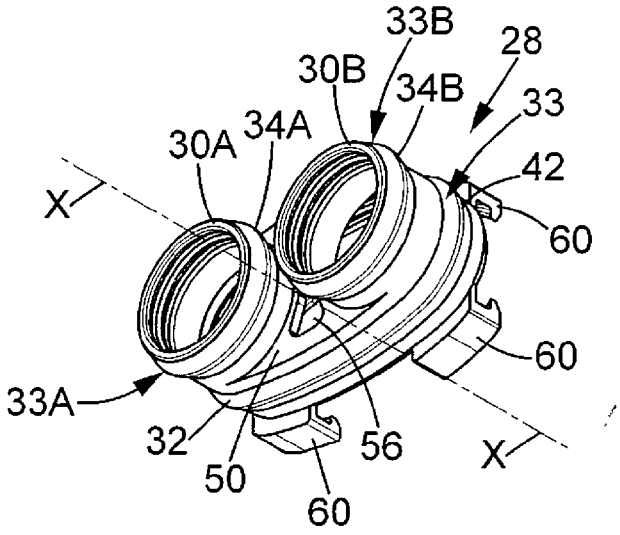
FIG. 6A is a perspective view of the sealing system provided on the second connector of FIG. 5B.
Figure 6B:
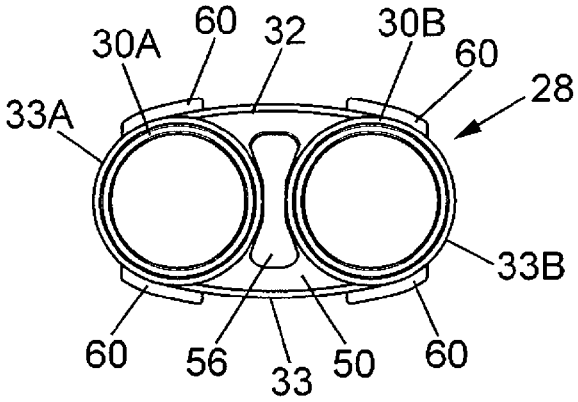
FIG. 6B is an upper view of the sealing system of FIG. 6A.
Figure 6C:
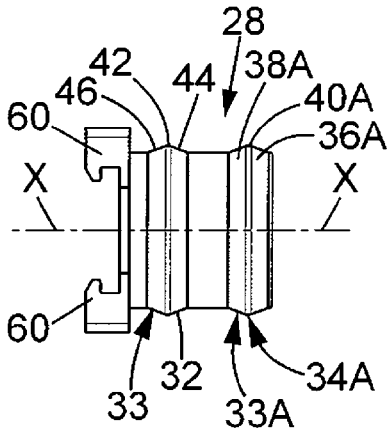
FIG. 6C is a lateral view of the sealing system of FIG. 6A.

The sealing system 28 of the invention may be of a silicon material and as depicted in details on FIGS. 6A-C, may be of one piece, the first and second frontward portions 30A and 30B extending side by side from and integrally with the rearward portion 32 along the mating axis X-X. The rear housing has preferably an external oval shape, the rearward portion 32 having thus a corresponding external contour of an oval shape.

At least one of the frontward portion and rearward portion of the sealing system 28 can be an axial compression seal with regard to the mating axis X-X as schematically illustrated on FIG. 3A or it can be a radial compression seal with regard to the mating axis X-X as schematically illustrated on FIG. 3B or it can be both an axial compression seal and a radial compression seal. By the term "axial compression seal" it is meant a sealing system in which the material, under a compression force parallel to the mating direction, deforms in a direction substantially perpendicular to the mating axis X-X. The term "radial compression seal" designates a sealing system for which the material, under a compression force perpendicular to the mating axis, deforms in a direction substantially parallel to mating axis X-X.

Figure 7:
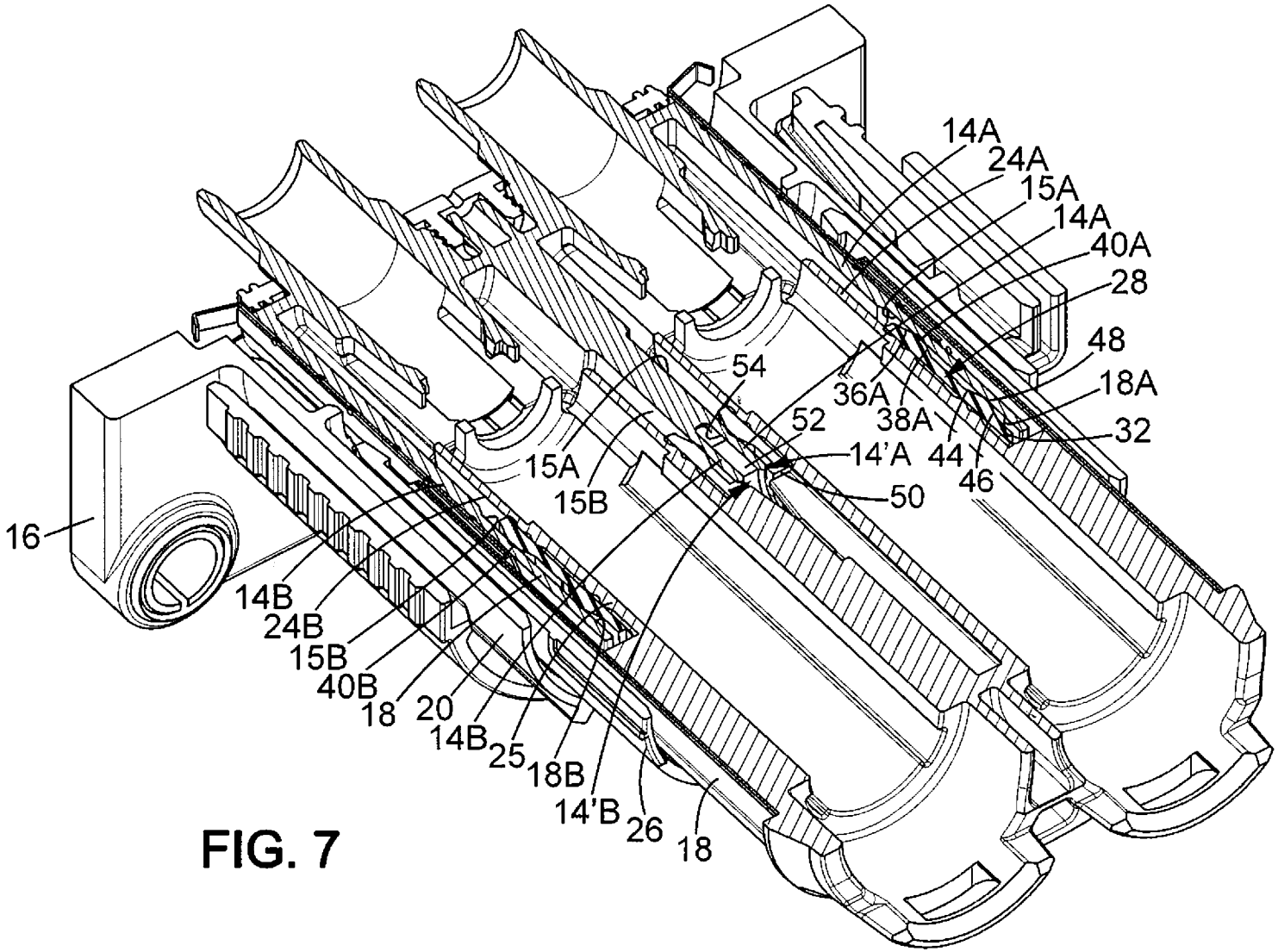
FIG. 7 is a cross-sectional view of the connector assembly obtained after mating the first connector of FIG. 4 with the second connector of FIG. 5B.
Figure 8:
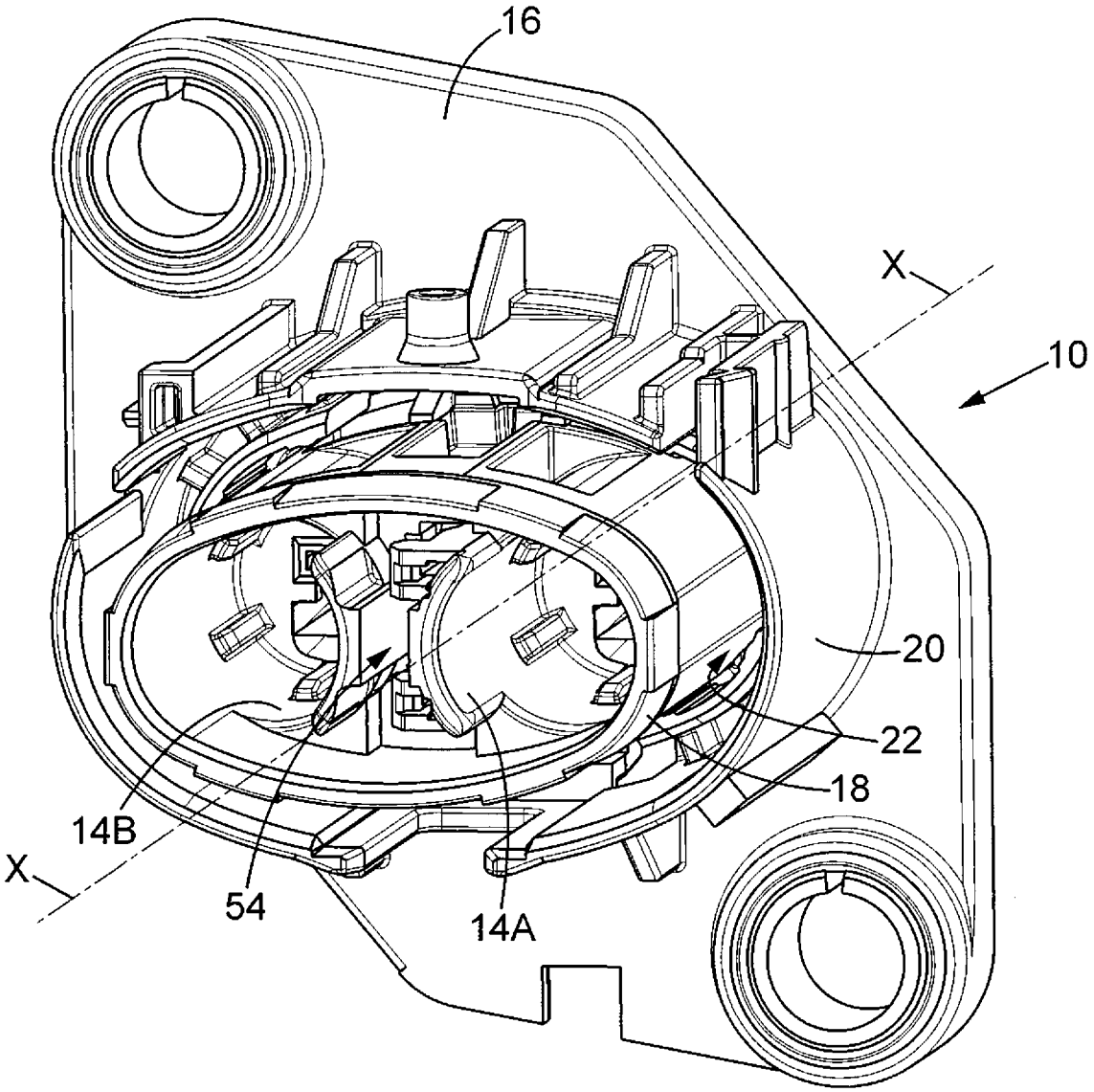
FIG. 8 is a perspective view of a first connector of a connector assembly according to another embodiment.
Figure 9A:
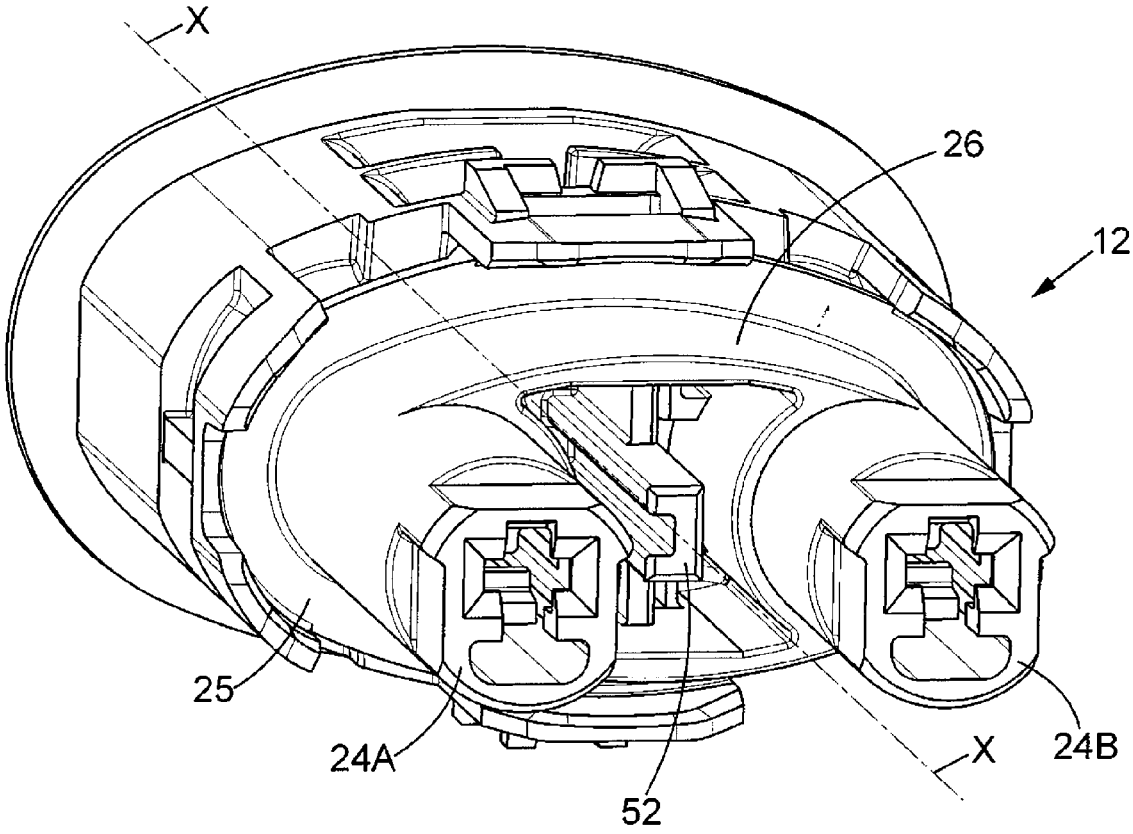
FIG. 9A is a perspective view of a second connector intended to mate with the first connector of FIG. 1.
Figure 9B:
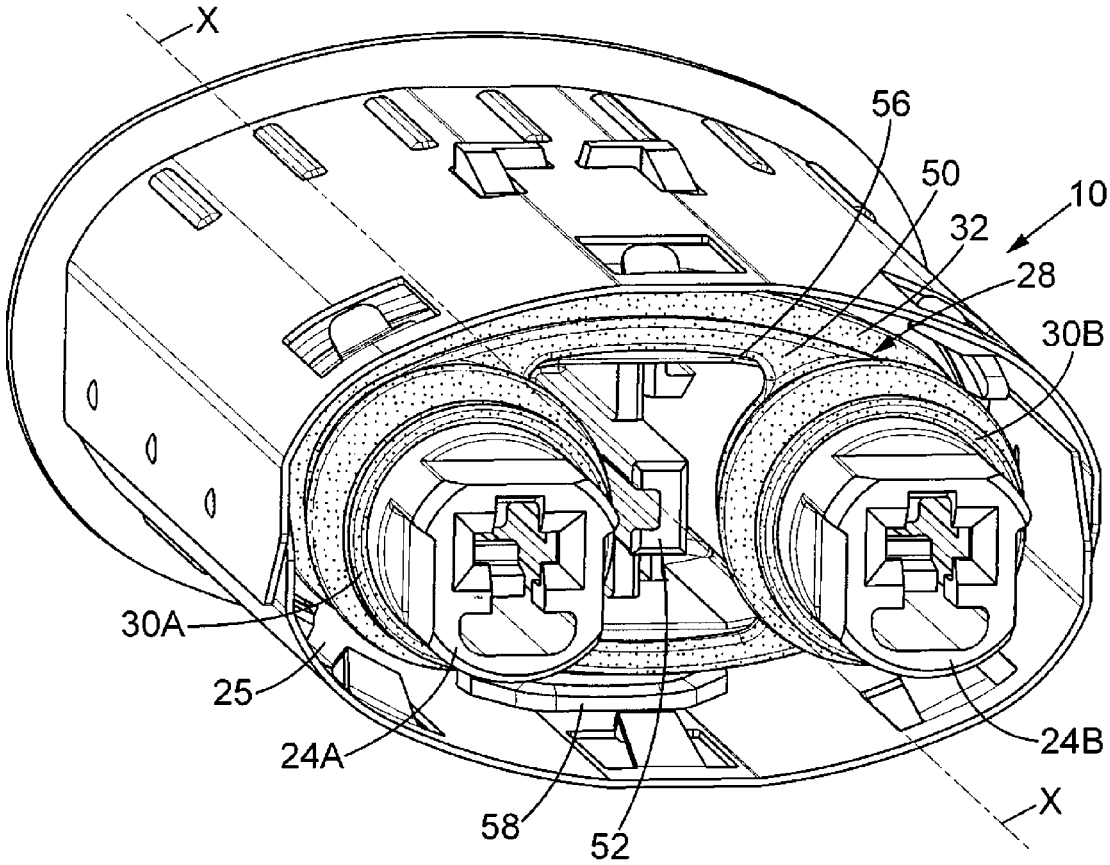
FIG. 9B is a perspective view of the second connector of FIG. 9A provided with a sealing system.
Figure 10A:
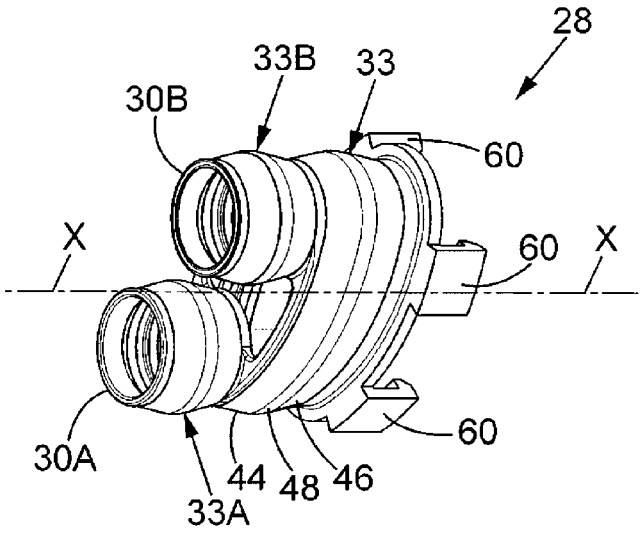
FIG. 10A is a perspective view of the sealing system provided on the second connector of FIG. 9B.
Figure 10B:
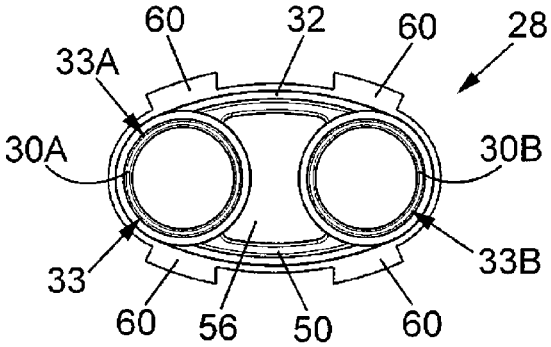
FIG. 10B is an upper view of the sealing system of FIG. 10A.
Figure 10C:
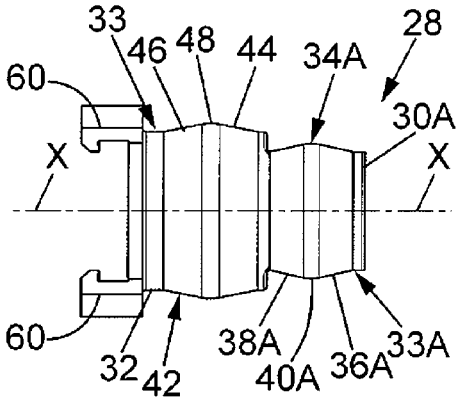
FIG. 10C is a lateral view of the sealing system of FIG. 10A.
Figure 12A:
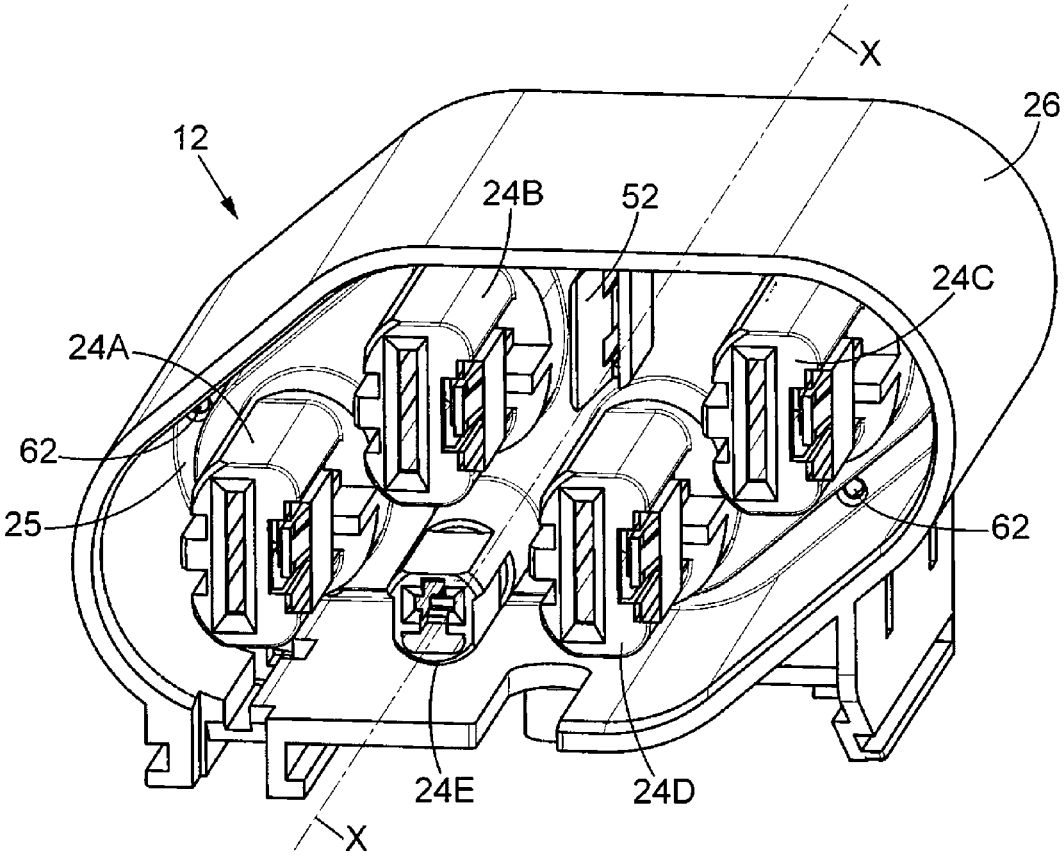
FIG. 12A is a perspective view of a second connector intended to mate with the first connector of FIG. 11.
Figure 12B:
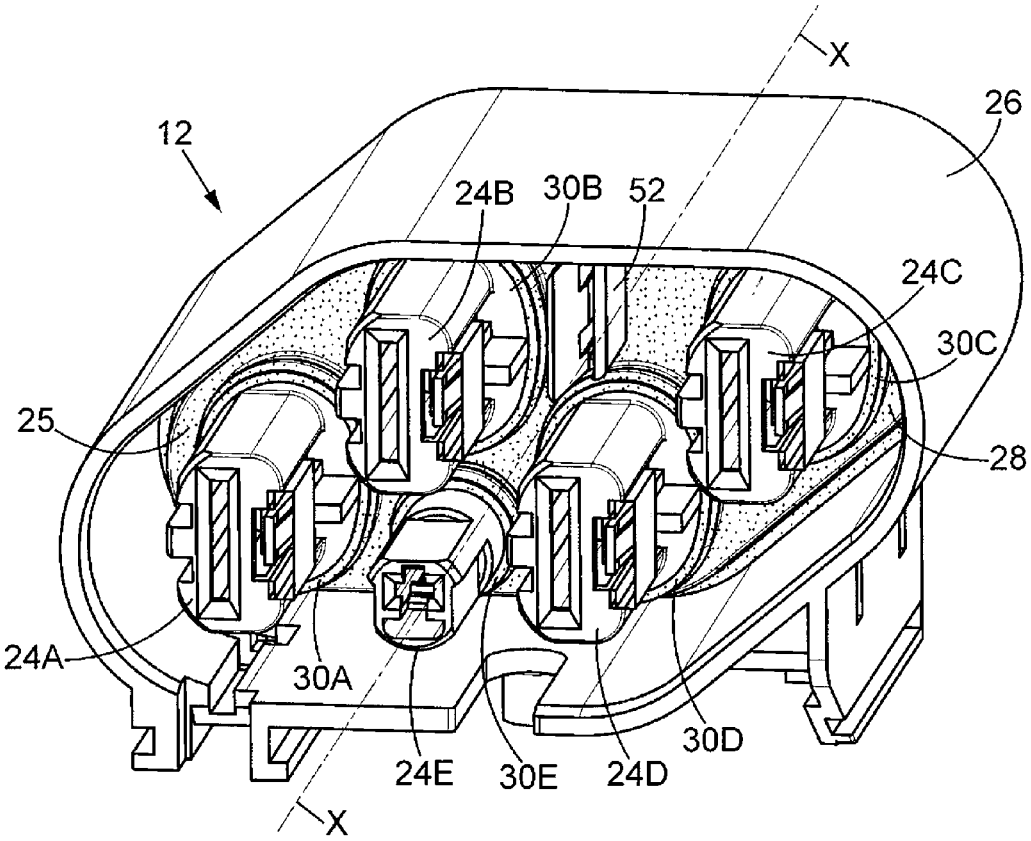
FIG. 12B is a perspective view of the second connector of FIG. 12A provided with a sealing system.
Figure 13A:
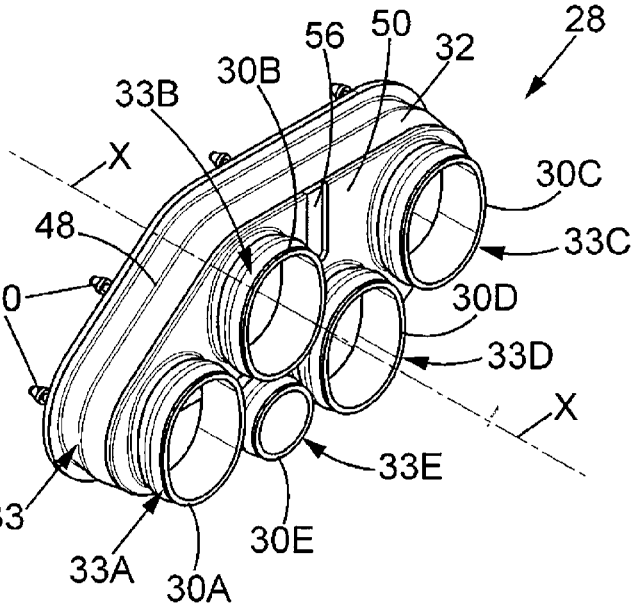
FIG. 13A is a perspective view of the sealing system provided on the second connector of FIG. 12B.
Figure 13B:
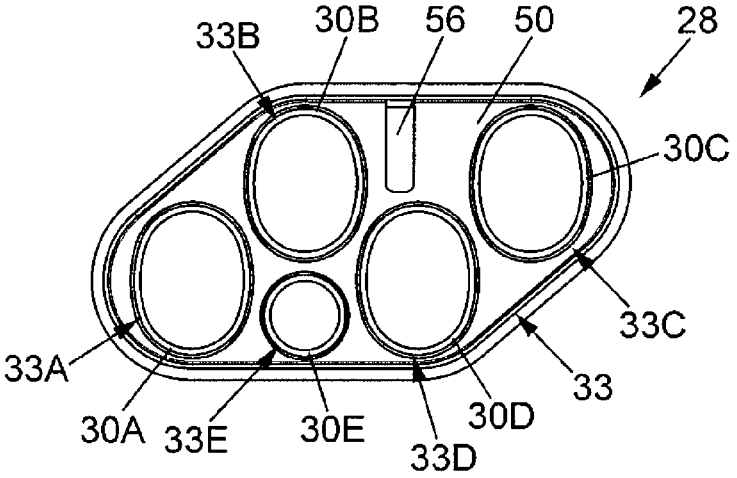
FIG. 13B is an upper view of the sealing system of FIG. 13A.
Figure 13C:
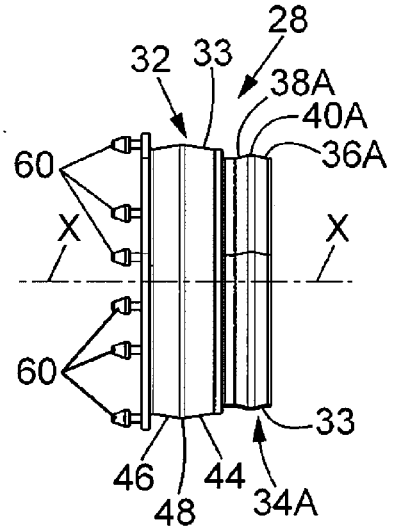
FIG. 13C is a lateral view of the sealing system of FIG. 13A.

For example, each of the first and second frontward portions 30A and 30B comprises an external surface 33A, respectively 33B, provided with a cylindrical bulging 34A, respectively 34B adapted to be compressed radially against the inner surface 15A and 15B of the inner housing 18 when the first and second connectors 10 and 12 mate (see FIG. 7). Each cylindrical bulging 34A, 34B comprises two inclined surfaces.

As best illustrated on FIG. 6C for the first frontward portion 30A (but it is the same for the second frontward portion 30B), the bulging 34A comprises two inclined annular surfaces 36A and 38A joined on an annular apex 40A. The apex 40A has an external contour which has a greater size than any other external contour of the first frontward portion 30A, such that it can be compressed when the first cylindrical sleeve 24A is received in the corresponding first cylindrical socket 14A (see FIG. 7). Due to this geometrical configuration, the first frontward portion 30A is compressed radially when the first and second connectors 10 and 12 mate.

A similar bulging 42 is provided on the external surface 33 of the rearward portion 32 adapted to be compressed against the inner surface 18A of the inner housing 18 when the first and second connectors mate. Similarly to the bulging 34A, the bulging 42 comprises two inclined annular surfaces 44 and 46 joined on an annular apex 48, the external contour size of it being also greater than any external contour size of the external surface 33 of the rearward portion 32.

As best illustrated on FIG. 7, the inner surface 18A of the inner housing 18 extends partly in line (i.e. in continuity) with the inner surface 15A and 15B of the corresponding first and second cylindrical sockets 14A and 14B. Similarly, the rear housing 25 of the second casing 26 extends also partly in line with the first 24A and second 24B cylindrical sleeves.

The external surface of rearward portion 32 further comprises a transverse flat area 50 adapted to be compressed against the free end 14'A, respectively 14'B of the first 14A and respectively second cylindrical socket 14B when the first and second connectors 10 and 12 mate (see FIG. 7). This flat area 50 connects the first and second frontward portions 30A and 30B together with the rearward portion 32.

In order to avoid any risk of error when connecting the first and second connectors together, the second casing 26 is provided with a polarization lug 52 extending along the mating axis X-X between the first and second cylindrical sleeves 24A and 24B. The first casing 16 is accordingly provided with a positioning recess 54 able to receive the polarization lug 52 in one position only.

The polarization lug 52 extends from the rear housing 25 between the first and second cylindrical sleeves 24A and 24B and passes through the sealing system 28. An opening 56, through which the positioning lug 52 extends, is therefore provided on the flat area 50 of the sealing system 28 between the two frontward portions 30A and 30B.

When the first and second connectors 10 and 12 mate the sealing system 28 reduces the risk of water and/or dust intrusion in the connectors. More precisely, the first and second frontward portions 30A and 30B seal respectively and separately the first and second power terminal sleeves, whereas the rearward portion 32 seals the first and second connectors 10 and 12.

As best seen on FIGS. 5A and 5B, in order to secure the mating of the two connectors 10 and 12, the second casing 26 may be provided with one or several connecting tongues 58 spread evenly on its external contour, forming connector retainers, and to be received within the annular space 22, between the inner and the outer housings 18 and 20 of the first casing 16.

In order to secure the sealing system 28 onto the second casing 26, the rearward portion 32 is provided with one or several retention means adapted to cooperate with complementary retention means of the second casing to retain the sealing system 28 via the rearward portion 32 onto the second connector 12.

More precisely, as illustrated on FIGS. 6A-6C, four rear lugs 60 having a shape of hooks are located evenly at the rear part of rearward portion 32 and are designed to cooperate with a corresponding annular flange 62 provided on the second casing 26.

As best illustrated on FIG. 5B, the four retaining lugs 60 are distributed alternatively between the connecting tongues 58 of the second casing 26.

FIGS. 8, 9A-9C and 10A-10C disclose another embodiment of a connector assembly having two power connectors.

The power contacts having a different size than those of the embodiment of FIGS. 4, 5A-B, 6A-C and 7, the first and second connectors 10 and 12 are slightly different. However, since they distinguish mostly only on their size, in order to avoid unnecessary repetition, only the important differences are mentioned below.

Actually, the first connector 10 is provided with a greater space between the first and second sockets 14A and 14B, consequently the positioning recess 54 is provided with two small lateral plates extending along the mating axis X-X. The polarization lug 52 is of a different shape compared with that of the embodiment of FIGS. 4, 5A-B, 6A-C. The sealing member 28 differs essentially on its size and on the shape of the opening 56. Actually, the opening 56 is greater and takes mostly all the place of the space available on the flat area 50 between the two frontward portions 30A and 30B, the curvature of the concave faces of the opening follow partly the contour of the two frontward portions 30A and 30B.

We will now describe an embodiment of a connector assembly having five power contacts, four of a similar size and a fifth one which is smaller. Connector assemblies having another number of power contacts, the power contacts being of the same or of different sizes are also part of the invention.

Referring to FIGS. 11, 12A-B and 13A-C, the connector assembly comprises mainly the same elements and differs essentially from the above-mentioned connectors having two power contacts by the fact that it is provided with a different location of the power contacts.

The first connector 10 (see FIG. 11) comprises a first cylindrical socket 14A, a second one 14B, a third one 14C, a fourth one 14D and a fifth one 14E. The first, second, third and fourth cylindrical sockets 14A-14D are preferably each of the same size and of the same shape, whereas the fifth cylindrical socket 14E is smaller and of a different shape. More precisely, the first, second, third and fourth cylindrical sockets 14A-14D are mostly of an oval external shape (viewed in cross-section perpendicular to the mating axis), whereas the fifth cylindrical socket 14E is rather of a circular shape (viewed in cross-section section perpendicular to the mating axis).

The five cylindrical sockets may be joined one with at least one other. For instance, as illustrated, they are side by side and joined by pairs along the mating axis X-X. The fifth cylindrical socket 14E is for instance located between the first, second and fourth cylindrical socket 14A, 14B and 14D.

The second connector 12 (see FIGS. 12A and 12B) to be connected with the first connector 10 of FIG. 11 comprises five corresponding cylindrical sleeves 24A-24E. More precisely, the first, second, third and fourth cylindrical sleeves 24A-24D are each of the same size and shape (i.e. oval), whereas the fifth cylindrical socket 24E is smaller and has a circular shape.

The fifth cylindrical sleeve 24E is, correspondingly to the fifth cylindrical socket 14E, located between the first, second and fourth cylindrical sleeve 24A, 24B and 24D.

The polarisation lug 52 may be located next to the second cylindrical socket 12B. The opening 56 provided on the sealing member 28 for the polarization lug 52 is mostly of a rectangular shape and is located correspondingly on the flat area 50 next to the second cylindrical socket 12B.

In order to secure the sealing system 28 onto the second casing 26 retainers, eight rear studs 60 terminating like an arrowhead are distributed evenly on the rear part of rearward portion 32 and are able to penetrate in corresponding holes 62 provided on the second casing 26.

As above-described for the connector assembly having two pairs of power contacts, the sealing system and more precisely the external surfaces 33A-33E of each frontward portion 30A-30E and the external surface 33 of the rearward portion are provided with a correspondent bulging similar to those above-mentioned.

In order to avoid any risk of contacting the power contacts with one finger when a user mate the first and second connectors together, each of the cylindrical sockets and each of the cylindrical sleeves surrounds the power contacts according to the standard IP2X.

These connector assemblies are represented in relation to a special application (i.e. vehicles), but could be used in other applications.

In the embodiments illustrated, the connector assembly comprises a first connector 10 and a second connector 12 intended to mate with the first one.

As illustrated schematically on FIG. 14 depicting a system, the first connector 10 may for example be carried by a base 64 of an automotive vehicle, whereas the second connector 12 may be carried by a power supply, more precisely a battery 66.

It will be appreciated by persons skilled in the art that the present invention is not limited by what has been particularly shown and described hereinabove. In particular, the invention is applicable to any kind of connectors, either electrical or optical. Further, although the description refers to connector assemblies for transmitting power, it is obviously transposable to connector assemblies that transfers signals

The invention claimed is:

1. A connector assembly comprising:

a first connector having a first casing and a plurality of first terminals; and a second connector having a second casing and a plurality of second terminals, wherein the first and second connectors are configured to mate and unmate along a mating axis to connect the first and second terminals together, wherein the first connector comprises a plurality of sockets, one socket of the plurality of sockets surrounding one first terminal of the plurality of first terminals and the second connector comprises a plurality of sleeves, one sleeve of the plurality of sleeves surrounding one second terminal of the plurality of second terminals, each socket being adapted to receive each sleeve when the first and second connectors mate, wherein the first casing comprises the plurality of sockets, wherein the second casing comprises a rear housing from which each sleeve projects forwardly along the mating axis, wherein the second casing includes a sealing system having a frontward portion and a rearward portion, and wherein the frontward portion surrounds each sleeve to seal each socket to each sleeve and the rearward portion surrounds the rear housing of the second casing to seal a housing of the first casing to the rear housing of the second casing when the first and second connectors are mated.

2. The connector assembly according to claim 1, wherein the frontward portion and the rearward portion are separate elements.

3. The connector assembly according to claim 1, wherein the frontward portion is integral with the rearward portion.

4. The connector assembly according to claim 1, wherein at least one of the frontward portion and rearward portion is an axial compression seal with regard to the mating axis.

5. The connector assembly according to claim 1, wherein at least one of the frontward portion and rearward portion is a radial compression seal with regard to the mating axis.

6. The connector assembly according to claim 5, wherein the frontward portion comprises an external surface provided with at least two cylindrical bulging features having two inclined annular surfaces joined on an annular apex and adapted to be radially compressed against the inner surface of the corresponding socket when the first and second connectors mate.

7. The connector assembly according to claim 5, wherein the rearward portion comprises an external surface provided with a bulging feature having two inclined annular surfaces joined on an annular apex and adapted to be radially compressed against the inner surface of the housing of the first casing when the first and second connectors mate.

8. The connector assembly according to claim 1, wherein the rearward portion comprises an external surface provided with a transverse flat area adapted to be compressed against the free end of the sockets when the first and second connectors mate.

9. The connector assembly according to claim 1, wherein the rearward portion is provided with a plurality of retention means adapted to cooperate with complementary retention means of the second casing to retain the rearward portion onto the second connector.

* * * * *